United States Patent [19]

Cuschera

[11] Patent Number: 4,856,910

[45] Date of Patent: Aug. 15, 1989

[54] MOTORIZED STIRRING APPARATUS

[76] Inventor: Casper Cuschera, 967 Industrial Pkwy. West, Hayward, Calif. 94544

[21] Appl. No.: 315,587

[22] Filed: Feb. 27, 1989

[51] Int. Cl.[4] ..... B01F 7/16

[52] U.S. Cl. ..... 366/282; 99/348; 366/251; 366/283; 366/605

[58] Field of Search ..... 366/64, 65, 97, 96, 366/130, 242, 244, 247, 249–252, 279, 281–284, 331, 605

[56] References Cited

U.S. PATENT DOCUMENTS

| | | | |
|---|---|---|---|
| 856,295 | 6/1907 | Prindle . | |
| 915,310 | 3/1909 | Rickman . | |
| 946,610 | 1/1910 | Malmquist et al. | 366/284 |
| 2,112,696 | 3/1938 | Gough | 366/284 |
| 3,010,616 | 11/1961 | Johnson | 366/284 |
| 3,011,768 | 12/1961 | Clark . | |
| 3,132,849 | 5/1964 | Kritikson . | |
| 3,357,685 | 12/1967 | Stephens | 366/282 |
| 3,635,147 | 1/1972 | Lee | 99/448 |
| 3,691,938 | 9/1972 | Nichols | 99/348 |
| 3,697,053 | 10/1972 | Will | 99/348 |
| 3,810,605 | 5/1974 | Lambert . | |
| 3,905,585 | 9/1975 | Wallman | 99/348 |
| 4,184,779 | 1/1980 | Detmer | 366/282 |

*Primary Examiner*—Timothy F. Simone

*Attorney, Agent, or Firm*—Harris Zimmerman; Howard Cohen

[57] ABSTRACT

Apparatus for stirring the contents of a container during cooking or during mixing of constituents of a liquid has a cross-beam which spans the container and which carries clamps that secure the cross-beam to opposite portions of the container rim. A stirrer shaft extends downward from the central region of the cross-beam and carries a stirring blade with vanes which extend from the shaft in opposite directions and which are inclined away from a vertical orientation to force the container contents upward as the blade revolves. An electrical motor, drive shaft and gearing mounted on the cross-beam turn the stirrer shaft and blade. The motor is located on an end of the cross-beam that extends away from the container. The apparatus provides for thorough mixing, easy cleaning and maintenance and isolates the motor from spatterings, vapors and heat that can arise from the container.

12 Claims, 2 Drawing Sheets

MOTORIZED STIRRING APPARATUS

TECHNICAL FIELD

This invention relates to apparatus for stirring liquids and more particularly to motor driven devices for continuously stirring the contents of cooking pots or other vessels.

BACKGROUND OF THE INVENTION

Many liquid or semi-liquid foods, such as sauces and soups for example, should be stirred during the cooking process to assure even heating, to intermix ingredients and to avoid overheating of the food at the bottom of the pot or the like. Such mixing can inhibit scorching or the formation of a thickened adhesive residue on the bottom of the pot and thereby simplify subsequent cleaning operations in addition to enhancing the quality of the cooked food.

These objectives are more effectively realized if the stirring is thorough and continuous but this is often not practical if the stirring must be done manually. Cooks or other kitchen helpers usually have a number of different operations to perform in the course of preparing food and can attend to stirring only intermittantly. Further, manual stirring with a spoon or the like does not intermix and circulate the contents of a pot to the extent that is most desirable for the above discussed purposes.

Continuous and vigorous stirring of the contents of a container can also be advantageous in operations other than cooking. The mixing of paints or liquid constituents of a variety of other chemical formulations are examples.

Motor driven stirring devices have heretofore been devised to provide for continuous stirring but have constructions which are not optimally suited for the purpose.

Prior motorized stirrers typically have a drive motor which is supported above the center of the pot by a number of support arms which overlap the rim of the pot. The motor turns a shaft which extends down into the contents of the pot and which carries one or more stirring blades.

The coventional configuration complicates cleaning and other maintenance of the apparatus and can accelerate deterioration of components such as the motor. A motor and other components situated immediately above the contents of the container can be subjected to spattering, rising vapors and high heat in instances where cooking is taking place. Residues can rapidly accumulate on such components and adversely affect the operation of the motor, bearings, gears and other components.

Some prior stirrers have a housing which encases the motor but this does not fully resolve the problems. It is usually not practical to provide a completely sealed housing and thus contamination can still reach sensitive components. The housing then complicates access to such components for clean-up. Cooling of electrical motors is usually dependent on air circulation and enclosure of such a motor in a nearly air tight housing can contribute to overheating, particular in the already hot environment above a cooking pot or the like.

Prior motorized stirrers typically rest on the rim of the pot or the like although in some instances clips or other engagement means are provided to aid in holding the stirring apparatus in place. These do not in general provide a desirably positive securing of the apparatus to the pot. Consequently, the stirring apparatus can easily be displaced during operation and chattering and a high level of noise can occur.

Further, the stirring blade configurations found on prior motorized stirrers do not directly displace the contents of the pot or the like as the blades revolve to the extent that would be most desirable for many purposes such as during the cooking of sauces. Such blades typically bear directly against only a limited part of the liquid in the pot and stirring of other regions of the liquid is at best indirect.

The present invention is directed to overcoming one or more of the problems discussed above.

SUMMARY OF THE INVENTION

In one aspect of the present invention, apparatus for stirring the contents of a container includes a cross-beam with a length sufficient to span the top of the container and to extend laterally outward from the container at a first end of the cross-beam. Clamping means releasably secure the cross-beam to the rim of the container. A rotatable stirrer shaft extends down from the central region of the cross-beam and a stirring blade extends radially from the stirrer shaft. An electrical drive motor is mounted on the first end of the cross-beam at a location which is laterally spaced apart from the container and means are provided for transmitting rotary drive from the motor to the stirrer shaft.

In another aspect, the invention provides apparatus for stirring the contents of a container of the type having a bead which defines the rim of the container. The apparatus includes a cross-beam proportioned to span the top of the container and to extend outward from the container at each of two opposite end regions of the cross-beam, the cross-beam having a plurality of spaced apart vertical passages in each of the end regions. One of a pair of clamp members is disposed beneath each end region of the cross-beam for temporarily securing the cross-beam to the top of the container, each clamp member having an inner edge shaped for disposition under a portion of the bead at the container rim. Means are provided for fastening each of the clamp members to the cross-beam at a selected one of the vertical passages of the cross-beam which means also enables vertical movement of the inner edges of the clamp members. Additional means are provided for urging the inner edges of the clamp members upward to exert clamping pressure against the underside of the container bead. A rotatable stirrer shaft extends downward from the central region of the cross-beam and a stirring blade secured to the lower portion of the shaft has a pair of vanes which extend radially outward from the shaft in opposite directions. An electrical drive motor is secured to one of the end regions of the cross-beam at a location which is laterally spaced from the container when the cross-beam is engaged on the container. A drive shaft extends along the cross-beam between the drive motor and the central region of the cross-beam and gear means are provided for transferring drive from the drive shaft to the stirrer shaft at the central region of the cross-beam.

The invention provides motor driven apparatus which vigorously, thoroughly and continually stirs the contents of a cooking pot or other container while being durable, easily cleanable and of an economical construction. The drive motor is situated away from the region above the pot and thus is isolated from spatteringqs, rising vapors and high heat which can be present immediately above the pot or the like. The apparatus clamps securely to pots of any of a variety of sizes thereby resisting displacement and minimizing vibration. In the preferred form, the apparatus has a blade configuration which directly intercepts a large proportion of the contents of the pot or the like and which exerts a lifting action on the intercepted liquid that promotes intermixing and uniform heating of all portions of the contents of the pot or the like.

DETAILED DESCRIPTION OF THE PREFERRED EMBODIMENT

Figures 1, 2, 8:
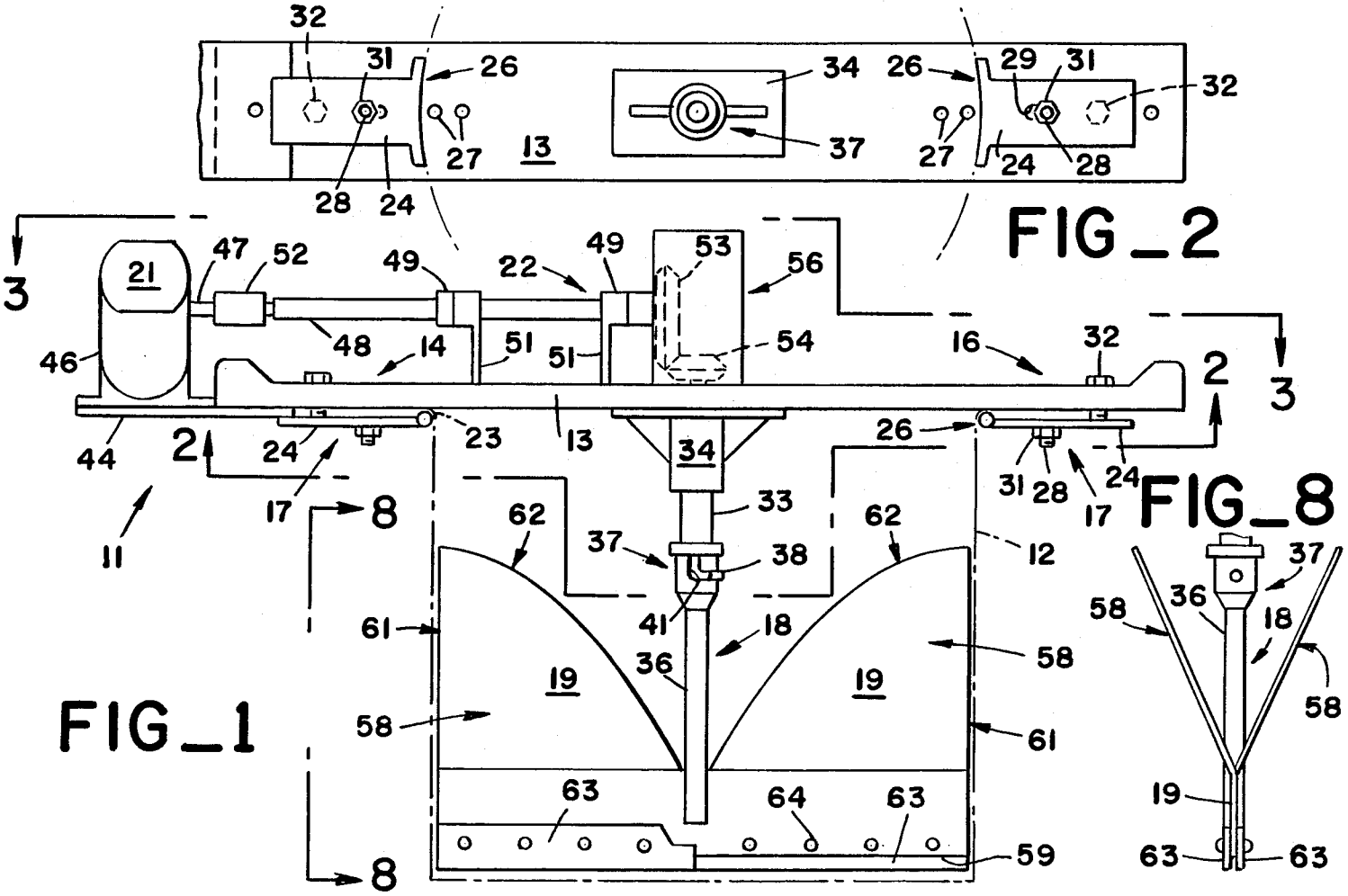
FIG. 1 is a side elevation view of motorized stirring apparatus in accordance with the preferred embodiment of the invention.
FIG. 2 is a view of the underside of portions of the apparatus of FIG. 1 taken along staggered line 2—2 thereof.
FIG. 8 is a side elevation view of the preferred stirring blade configuration taken along line 8—8 of FIG. 1.

Referring initially to FIG. 1 of the drawing, the motorized stirring apparatus 11 of this embodiment of the invention is designed for disposition across the open top of a container 12 which is a cooking pot in this example but which may also be any of variety of other vessels containing one or more liquids which are to be mixed. For this purpose, stirring apparatus 11 includes a linear cross-beam 13 which is of sufficient length to span the top of container 12 along a diameter of the container and to extend laterally outward from the container at first and second opposite end regions, 14 and 16 respectively, of the cross-beam.

Further major components of the stirring apparatus 11 include clamping means 17 for releasably securing the cross-beam 13 to the container 12, a rotatable stirrer shaft 18 which extends downward from the central region of the cross-beam, a stirring blade 19 secured to the shaft, an electrical drive motor 21 mounted on the cross-beam and means 22 for transmitting drive from the motor to the stirrer shaft, each of which components will hereinafter be described in more detail.

Referring jointly to FIGS. 1 and 2, the rims of cooking pots and many other containers typically have a bead 23 which extends slightly outward relative to the container wall. The clamping means 17 of this embodiment is designed to engage on the bead 23 and to exert upward clamping pressure on the bead which rigidly and securely holds the cross-beam 13 in place at the top of container 12. Means 17 includes a pair of clamp members 24 each of which is situated below a separate one of the end regions 14 and 16 of cross-beam 13 and each of which has an inner edge 26 which is shaped to fit under an adjacent portion of container bead 23.

Cross-beam 13 has a series of spaced apart vertical passages 27 at each end region 14 and 16 and each of the clamp members 24 is fastened to the cross-beam by one of a pair of bolts 28 which extends down through one of the passages 27 and through a slot 29 in the clamp member and on which a nut 31 is engaged below the clamp member. Engagement and disengagement of the apparatus 11 at container 12 is simplified by a pair of additional bolts 32. In particular, the nuts 31 at the underside of cross-beam 13 need not be tightened to the extent that would be required to create the desired clamping pressure against the underside of bead 23 by such nuts acting alone. Instead, cross-beam passages 27 are threaded and one of the additional bolts 32 is threaded into one of the cross-beam passages 27 at each end region 14 and 16 and tightened from the top to bear downwardly against the underlying clamp member 24 at a location which is outward from that of the bolt 28 and nut 31 that fastens that clamp member to the cross-beam 13. This pivots the inner edges 26 of the clamp members 24 upward, with nuts 31 acting as fulcrums, to create the desired upward pressure of such edges against the underside of bead 23. Tightening and relaxing bolts 32 at the top of the apparatus 11 is a simpler operation than tightening nuts 31 at the underside of cross-beam 13.

Figure 3:
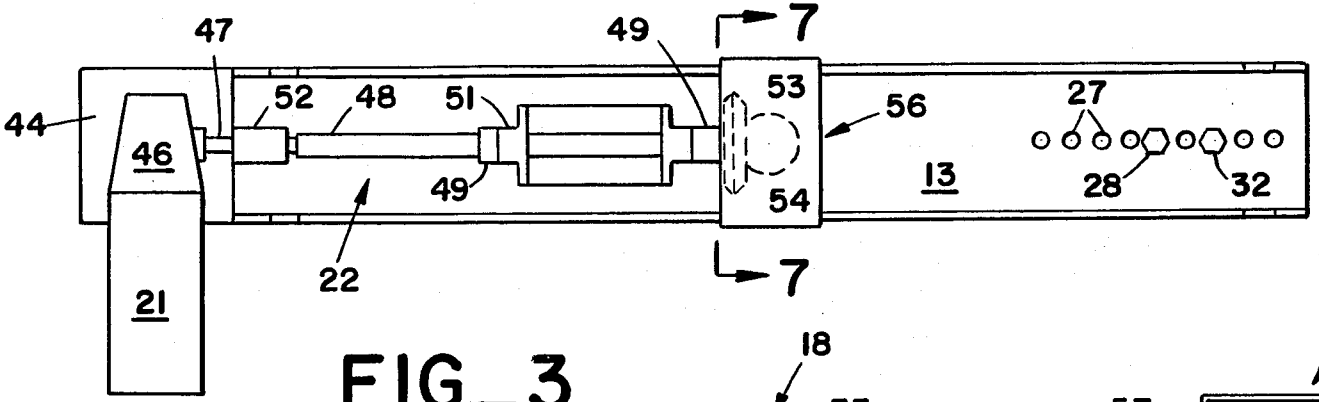
FIG. 3 is a top view of the stirring apparatus of FIG. 1.
Figure 4:
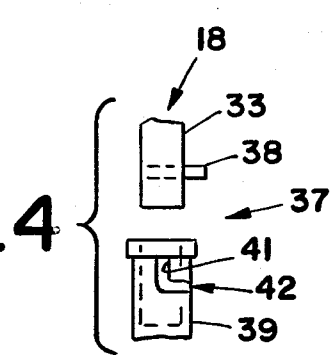
FIG. 4 is an elevation view showing components of a stirring shaft coupler in disengaged condition.
Figure 5:
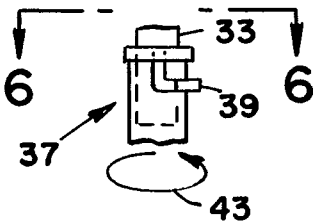
FIG. 5 is an elevation view of the coupler components of FIG. 4 in the engaged condition.

Slots 29 enable the clamp members 24 to be slid towards and away from container bead 23 while bolts 32 are untightened thereby further simplifying the engagement and disengagement of clamping means 17. Referring now to FIGS. 1 and 3 in combination, the presence of a series of passages 27 at each end region of cross-beam 13 enables the apparatus 11 to be engaged on containers 12 of different diameter. Bolts 31 and 32 may be inserted into selected ones of such passages 27 to accommodate to the diameter of the particular container 12. With bolts 28 situated in the particular passages 27 that best accommodate to the particular container 12, slots 29 enable sliding of clamp members 24 relative to cross-beam 13 if necessary to assure that inner edges 26 contact the wall of the particular container.

Referring again to FIGS. 1 and 2, the upper portion 33 of stirrer shaft 18 is journalled in a sleeve bearing 34 which extends downward from the underside of the central region of cross-beam 13. The upper portion 33 and lower portion 38 of the stirrer shaft 18 are preferably separable elements joined by a coupler 37 which enables disconnection of the lower portion and blade 19 from the other components of the apparatus 11. This provides for easier transport and storage of the apparatus 11 and enables replacement of the blade 19 with others of different proportions to accommodate to containers 12 of different sizes.

Referring jointly to FIGS. 3 to 6, the coupler 37 may include a pin 38 extending radially from the lower end of the upper portion 33 of shaft 18 and a socket 39 at the upper end of the lower portion 38 into which the base of the upper portion including pin 38 is received. Socket 39 has an angled slot 41 which extends downward and then circumferentially for a short distance around the wall of the socket, the end 42 of the slot being slightly enlarged. During engagement of the coupler 37, pin 38 travels into the vertical portion of slot 41 and the socket is then turned to seat the pin in the enlarged end 42 of the slot. The movement is reversed to disengage the coupler 37.

The lower portion of slot 41 extends from the vertical portion in the direction 43 of rotation of the shaft 18.

Thus, with reference again to FIG. 1, the resistance to the rotation of blade 19 and shaft 18 exerted by the liquid contents of the container 12 generates a force which acts in a direction that maintains the pin 38 in its seated position at the end of slot 41 but the coupler 37 may easily be disengaged when desired by a simple movement of the operator's hand.

Referring again to FIGS. 1 and 3, the electrical drive motor 21 is preferably of the variable speed type and is secured to the first end 14 of cross-beam 13 by a mounting bracket 44. This situates the motor 21 at a location which is laterally outward from container 12. The motor 21 is thereby isolated from spatters of liquid, condensable vapors and the high heat which can occur or be present in the region directly above the container 12 and does so without requiring that the motor be enclosed within a protective housing.

The drive output component of the motor 21 of this embodiment is a speed reducing gearbox 46 having an output shaft 47 oriented at right angles to the axis of the motor. Thus the motor 21 is mounted in a right angled orientation to cross-beam 13 in this example. Means 22 for transmitting rotary drive from motor 21 to stirrer shaft 33 includes a drive shaft 28 which extends along the cross-beam 13 between the motor and the central region of the cross-beam, the drive shaft being spaced above the cross-beam and being journalled by a pair of bearings 49 supported by brackets 51 which extend down to the cross-beam.

The outer end of drive shaft 48 receives drive from gearbox output shaft 47 through a coupling 52 and a first bevel gear 53 mounted on the inner end of the drive shaft engages a second smaller, orthogonally oriented bevel gear 54 on the upper end of stirrer shaft 18 to turn the stirrer shaft and blade 19.

Figure 7:
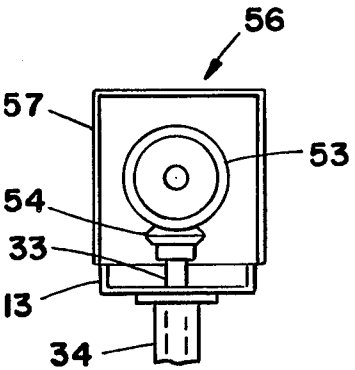
FIG. 7 is a cross section view taken along line 7—7 of FIG. 3 and depicting drive transmitting gearing of the stirring apparatus.
Figure 6:
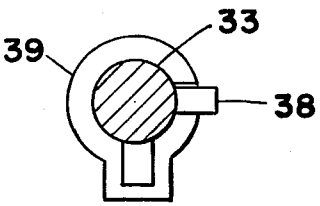
FIG. 6 is a plan section view taken along line 6—6 of FIG. 5.

To guard against accidental catching of the operator's fingers or other objects by the bevel gears 53 and 54, such gears are partially enclosed by a rectangular housing 56 which is secured to the cross-beam 13. This purpose can be served without complete enclosure of the gears 53 and 54 which would complicate the process of cleaning the apparatus 11. In particular, with reference jointly to FIGS. 1 and 7, the end 57 of housing 56 which faces towards drive shaft 48 and motor 21 is open to provide access to the gears for cleaning or other purposes.

Referring now to FIGS. 1 and 8 in conjunction, the stirring blade 19 of this embodiment has a preferred configuration which maximizes the degree of stirring and promotes uniform heating of all portions of the contents of container 12. In particular, blade 19 has a pair of vanes 58 which extend radially outward from the lower end of shaft 18 in diametrically opposite directions. Each such vane 58 has a horizontal lower edge 59, a vertical outer edge 61 which preferably extends to the upper region of container 12 and an inner edge 62 which curves progressively more downward from outer edge 61 towards the lower end of stirrer shaft 18. The blade 19 is preferably proportioned to have a horizontal extent conforming to the inner diameter of the container 12 in instances where it is to be used with containers of a particular size. Blades 19 of different sizes can be provided to meet this condition where the apparatus 11 may be used with containers 12 of substantially different proportions.

The above described blade 19 configuration may in some cases result in some sliding contact of the blade 19 and the bottom of the container 12. Abrasion, noise and frictional resistance can be minimized by providing a lining 63 along the lower edge 59 of each vane 58 of material which has a lower coefficient of friction that the material of blade 19 which may be steel or other metal. The linings 63 may, for example, be strips of polytetrafluorethylene (TEFLON) plastic which extend slightly below the metal portion of the blade 19. The lininqs 63 are preferably secured to the particular face of each vane 58 that intercepts liquid as the blade 19 turns. Thus the reaction force produced by interception of fluid or by frictional contact with the floor of container 12 does not pull against the rivets 64 or other fasteners that attach the linings 63 to the blade 19 and promote loosening.

Thorough mixing and uniformity of heating are further promoted by inclining the upper region of each vane 58 away from vertical, as best seen in FIG. 8 in particular, to cause the blade 19 to exert a lifting effect on the liquid which it intercepts as it turns. The vanes 58 may, for example, lean backward relative to the direction of travel at an angle of about 10 degrees from vertical although other inclinations can also produce the desired effect. The angling of vanes 58 causes a continuous upflow of liquid from the bottom region of the container 12 and a continuous replacement of the raised liquid with cooler liquid from the higher regions of the container. This avoids over-heating of the liquid at the base of the container 12 and inhibits the formation of a sticky or scorched residue on the bottom of the container.

While the motor 21 is offset from the region above container 12 primarily for the purpose of protecting the motor from contamination and possible heat induced deterioration, it should be observed that this motor placement also results in less obstruction at the top of the container. Viewing of the contents of the container 12 during cooking or other operations and access to the container for tasting or other reasons is facilitated.

While the invention has been disclosed with respect to a particular preferred embodiment for purposes of example, many modifications and variations of the construction are possible and it is not intended to limit the invention except as defined in the following claims.

I claim:

1. Apparatus for stirring the contents of a container comprising:

a cross-beam having a length sufficient to span the top of said container and to extend laterally outward therefrom at a first end portion of the cross-beam, clamping means for releasably securing said cross-beam to the rim of said container in an orientation at which said cross-beam extends across the top of said container with said first end portion extending laterally outward from the rim of said container, a rotatable stirrer shaft extending downward from the central region of said cross-beam, a stirring blade secured to said stirrer shaft and extending radially therefrom, an electrical drive motor mounted on said first end portion of said cross-beam at a location which is laterally spaced apart from the location of said container when said cross-beam is engaged thereon, and means for transmitting rotary drive from said motor to said stirrer shaft.

2. The apparatus of claim 1 further including a bearing secured to said central region of said cross-beam, said stirrer shaft being journalled in said bearing and having an upper end which extends upward from said bearing and said cross-beam, and wherein said means for transmitting rotary drive from said motor to said stirrer shaft includes a drive shaft journalled to said cross-beam and extending along said cross-beam between said drive motor and the region of said upper end of said stirrer shaft, a first bevel gear secured to said upper end of said stirrer shaft and a second orthogonally oriented bevel gear secured to said drive shaft and being engaged with said first bevel gear.

3. The apparatus of claim 2 further including a housing secured to said cross-beam and partially enclosing said first and second bevel gears, said housing having an open side which faces said drive shaft and drive motor.

4. The apparatus of claim 1 wherein said stirring blade has first and second vanes which extend radially from said stirrer shaft in opposite directions, at least the upper regions of said vanes being inclined away from a vertical orientation in opposite directions to cause intercepted portions of said contents of said container to flow upward as said vanes revolve.

5. The apparatus of claim 4 wherein each of said vanes is secured to said stirrer shaft substantially at the bottom region of said stirrer shaft and the vane and has an outermost edge lying in a vertical plane and an intermost edge that extends upward and progressively further away from said stirrer shaft.

6. The apparatus of claim 4 wherein said vanes are formed of a first material, further including a lining of a second material secured along the bottom edges of said vanes and extending therebelow, said lining being a second material having a lower coefficient of friction than said first material.

7. The apparatus of claim 6 wherein said lining includes first and second strips of said second material secured to the lower edges of said first and second vanes respectively, said strips being abutted against the surfaces of said vanes that face into the direction of movement of said vanes as said stirrer shaft revolves.

8. The apparatus of claim 1 wherein said cross-beam is proportioned to extend outward from said rim of said container at both ends of said cross-beam, wherein said clamping means includes a pair of clamp members each disposed at the underside of said cross beam at opposite end regions thereof and each having an inner edge facing said central region of said cross-beam that is shaped for engaging said rim of said container, means for fastening each of said clamp members to said cross-beam while enabling limited movement of the clamp member along the cross-beam, and means for temporarily immobilizing said clamp members relative to said cross-beam at positions where said inner edges of said clamp members engage said rim of said container.

9. The apparatus of claim 8 wherein said container has a bead enlargement defining said rim thereof, and wherein said means for fastening said clamp members to said cross-beam position said clamp members in a slightly spaced apart relationship therewith enabling limited vertical pivoting movement of inner edge of said clamp members relative to said cross member, and wherein said means for temporarily immobilizing said clamp members exerts pressure against said clamp members in a direction which urges said inner edges of said clamp members upward in order to exert clamping pressure against the underside of said bead of said container.

10. The apparatus of claim 8 wherein said cross-beam is transpierced by a plurality of spaced apart threaded passages at each end region thereof and each of said clamp members has a slot extending therealong, wherein said means for fastening said clamp members to said cross-beam includes a first pair of threaded bolts each extending through a selected one of said passages of said cross-beam at opposite ones of said end regions thereof and extending through said slot of the subjacent one of said clamp members and a pair of threaded nuts each engaged on a separate one of said first pair of threaded bolts below one of said clamp members, and wherein said means for temporarily immobilizing said clamp members includes a second pair of threaded bolts each being engaged in a selected one of said passages of said cross-beam at opposite ones of said end regions thereof, the lower ends of said second pair of bolts being in contact with the upper surface of the subjacent one of said clamp members to exert downward pressure thereon at a location which is further away from said inner edge of the clamp member than the one of said first pair of bolts that extends through said slot of the clamp member.

11. The apparatus of claim 1 wherein said stirrer shaft has separable upper and lower portions, said upper portion being journalled to said cross-beam and said lower portion having said stirring blade secured thereto, further including a coupling for said upper and lower portions of said shaft which includes a pin extending radially from the lower end of said upper portion of said shaft and a socket forming the upper end of said lower portion of said shaft and into which said lower end of said upper portion of said shaft is received, said socket having an angled slot in the wall thereof for receiving said pin which slot has an upper region that extends vertically along said wall of said socket and a horizontally extending lower region which extends in the direction of rotation of said shaft.

12. Apparatus for stirring the contents of a container which has a bead defining the rim thereof, comprising:

a cross-beam proportioned to span the top of said container and to extend outward therefrom at each of two opposite end regions of the cross-beam, said cross beam having a plurality of spaced apart vertical passages in each of said end regions thereof, a pair of clamp members for temporarily securing said cross-beam to the top of said container, each being disposed beneath a separate one of said end regions of said cross-beam and each having an inner edge shaped for disposition under a portion of said bead of said container, means for fastening each of said clamp members to said cross-beam while enabling vertical movement of said inner edges thereof relative to said cross-beam, means for urging said inner edges of said clamp members upward to exert clamping pressure against the underside of said container bead, a rotatable stirrer shaft extending downward from the central region of said cross-beam and being journalled thereto, a stirring blade secured to the lower portion of said stirrer shaft and having a pair of vanes which extend radially relative thereto in opposite directions, an electrical drive motor secured to one of said end regions of said cross-beam at a location thereon which is laterally spaced from said container when said cross-beam is engaged thereon, a drive shaft extending along said cross-beam between said drive motor and said central region thereof, and gear means for transferring drive from said drive shaft to said stirrer shaft at said central region of said cross-beam.

* * * * *